US009743178B2

(12) United States Patent
Chou

(10) Patent No.: US 9,743,178 B2
(45) Date of Patent: Aug. 22, 2017

(54) WATERPROOF SPEAKER

(71) Applicant: MEILOON INDUSTRIAL CO., LTD., Tao Yuan (TW)

(72) Inventor: Yeh-Feng Chou, Tao Yuan (TW)

(73) Assignee: MEILOON INDUSTRIAL CO., LTD., Taoyuan (TW)

( * ) Notice: Subject to any disclaimer, the term of this patent is extended or adjusted under 35 U.S.C. 154(b) by 0 days.

(21) Appl. No.: 15/158,692

(22) Filed: May 19, 2016

(65) Prior Publication Data

US 2017/0195784 A1 Jul. 6, 2017

(30) Foreign Application Priority Data

Dec. 31, 2015 (CN) ..... 2015 2 1120994 U

(51) Int. Cl.

| | |
|---|---|
| ***H04R 25/00*** | (2006.01) |
| ***H04R 1/44*** | (2006.01) |
| ***H04R 7/18*** | (2006.01) |
| ***H04R 9/06*** | (2006.01) |
| ***H04R 9/02*** | (2006.01) |
| ***H04R 9/04*** | (2006.01) |
| ***H04R 1/24*** | (2006.01) |

(52) U.S. Cl.

CPC ..... *H04R 1/44* (2013.01); *H04R 1/24* (2013.01); *H04R 7/18* (2013.01); *H04R 9/025* (2013.01); *H04R 9/045* (2013.01); *H04R 9/06* (2013.01)

(58) Field of Classification Search

CPC . H04R 1/026; H04R 1/24; H04R 7/18; H04R 1/44; H04R 9/025

See application file for complete search history.

(56) References Cited

U.S. PATENT DOCUMENTS

| | | | | |
|---|---|---|---|---|
| 6,626,262 | B1 * | 9/2003 | Chen | H04R 9/043 181/149 |
| 2008/0013780 | A1 * | 1/2008 | Kobayashi | H04R 9/043 381/398 |
| 2014/0363041 | A1 * | 12/2014 | Zhao | H04R 1/00 381/414 |

* cited by examiner

*Primary Examiner* — Simon King

(74) *Attorney, Agent, or Firm* — Jackson IPG PLLC; Demian K. Jackson

(57) ABSTRACT

A waterproof speaker includes a frame having a flared front opening with a diaphragm mounted thereto; a magnetic element mounted to a rear end of the frame; a voice coil support located in a central gap of the magnetic element and connected to the diaphragm; a suspension; a central post located inside the voice coil support and associated with the magnetic element; a coaxial tweeter connected to the central post; a voice coil located around the voice coil support; and a water-proofing unit located between the voice coil support and the central post without changing the height of the speaker and the stroke of the voice coil. The diaphragm and the water-proofing unit together prevent external moisture from reaching the magnetic element, enabling increased stability of the voice coil and prolonged outdoor service life of the SPEAKER.

6 Claims, 3 Drawing Sheets

WATERPROOF SPEAKER

FIELD OF THE INVENTION

The present invention relates to a speaker, and more particularly to a waterproof speaker that includes a water-proofing unit capable of preventing external moisture from entering into the speaker and accordingly, can have prolonged outdoor service life.

BACKGROUND OF THE INVENTION

Generally, a conventional coaxial speaker includes a frame and a magnetic element in the form of an annular magnet mounted to a rear end of the frame. In the frame, there are a voice coil, a voice coil support, a diaphragm, and a suspension. A coaxial tweeter is mounted to a front center of the speaker. With the above arrangements, the coaxial speaker can cooperate with other related electronic apparatus to output sound.

In the above speaker structure, there is a gap between the coaxial tweeter and the voice coil support. When the coaxial speaker is used outdoors, external moisture tends to invade the speaker via the gap between the coaxial tweeter and the voice coil support and reach into the annular magnet. The moisture accumulated in the annular magnet over a long time will affect the normal operation of the polar plates in the annular magnet and the voice coil to even shorten the service life of the coaxial speaker.

SUMMARY OF THE INVENTION

A primary object of the present invention is to overcome the shortage of the conventional coaxial speaker by providing a waterproof speaker that includes a water-proofing unit capable of preventing external moisture from entering into the speaker, so that different elements of the waterproof speaker, particularly the magnetic element and the voice coil, are protected against moisture to give the waterproof speaker a prolonged outdoor service life. Meanwhile, the water-proofing unit mounted in the speaker does not cause any change of the original height of the speaker and the stroke of the voice coil.

To achieve the above and other objects, the waterproof speaker according to the present invention includes a frame, a voice coil and a water-proofing unit. The frame has a flared front opening, to which a diaphragm is mounted. A magnetic element is mounted to a rear end of the frame; a voice coil support is located in a central gap of the magnetic element and connected to the diaphragm; a suspension is located around an outer side of the voice coil support; a central post is located inside the voice coil support and associated with the magnetic element; and a coaxial tweeter is connected to the central post. The voice coil is suspended in the central gap of the magnetic element and located around a lower part of the voice coil support below a middle point thereof. The water-proofing unit is located between the voice coil support and the central post.

According to an embodiment of the present invention, the water-proofing unit includes an inner ring section connected to around the central post, an outer ring section circumferentially connected to the voice coil support, and a connecting section located between the inner ring section and the outer ring section to connect the inner and the outer ring section to each other.

According to an embodiment of the present invention, the water-proofing unit is made of an elastic waterproof material.

According to an embodiment of the present invention, the connecting section of the water-proofing section has a downward curved cross-sectional shape.

According to an embodiment of the present invention, the connecting section of the water-proofing section has an upward curved cross-sectional shape.

According to an embodiment of the present invention, the connecting section of the water-proofing section has a corrugated cross-sectional shape.

According to an embodiment of the present invention, the connecting section of the water-proofing section has a flat cross-sectional shape.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

Figure 1:
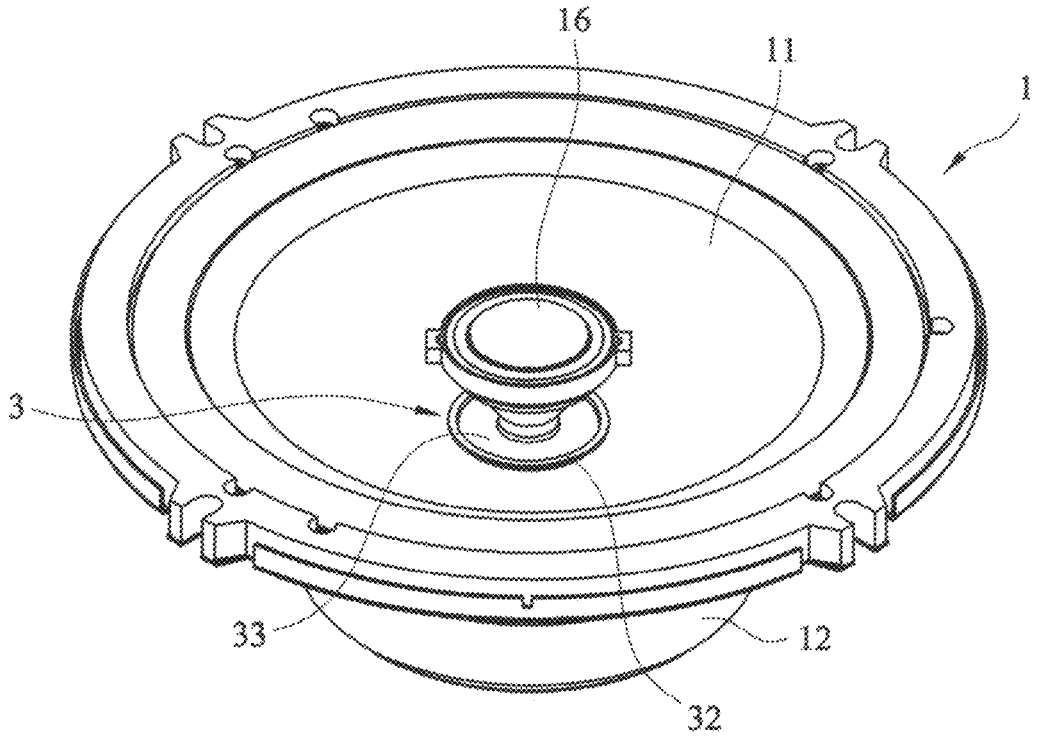
FIG. 1 is a perspective view of a waterproof speaker according to a preferred embodiment of the present invention.
Figure 2:
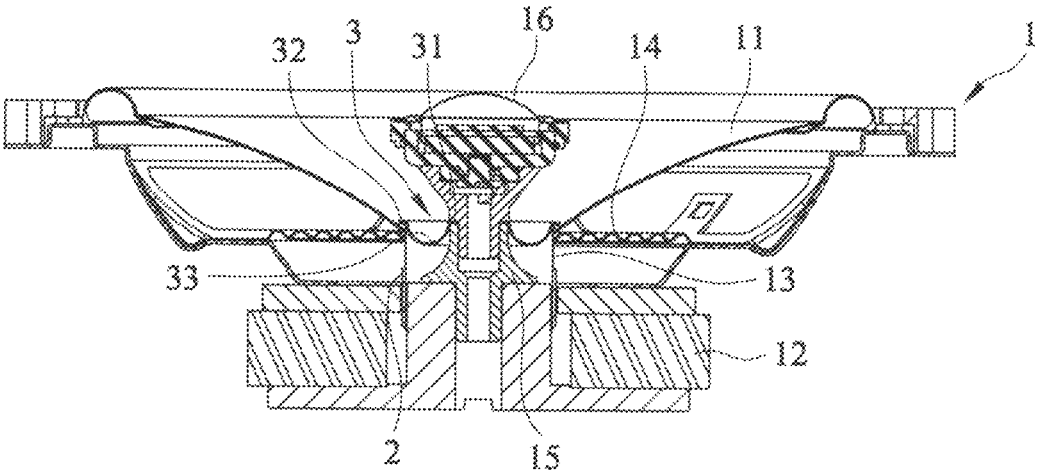
FIG. 2 is a sectional view of the waterproof speaker of FIG. 1.

Please refer to FIGS. 1 and 2, which are perspective and sectional views, respectively, of a waterproof speaker according to a preferred embodiment of the present invention. As show, the waterproof speaker of the present invention includes a frame 1, a diaphragm 11, a magnetic element 12, a voice coil support 13, a suspension 14, a central post 15, a coaxial tweeter 16, a voice coil 2, and a water-proofing unit 3.

The frame 1 has a flared front opening, the diaphragm 11 is mounted to the flared front opening of the frame 1, the magnetic element 12 is mounted to a rear end of the frame 1, the voice coil support 13 is located in a central gap of the magnetic element 12 and connected to the diaphragm 11, the suspension 14 is located around an outer side of the voice coil support 13, the central post 15 is located inside the voice coil support 13 and associated with the magnetic element 12, and the coaxial tweeter 16 is connected to the central post 15.

The voice coil 2 is suspended in the central gap of the magnetic element 12 and located around a lower part of the voice coil support 13 below a middle point thereof.

Figure 3:
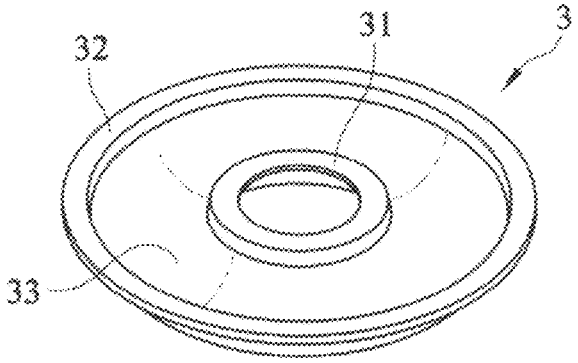
FIG. 3 is a perspective view of a water-proofing unit included in the waterproof speaker of the present invention.

FIG. 3 is a perspective view of the water-proofing unit 3. Please refer to FIG. 3 along with FIGS. 1 and 2. The water-proofing unit 3 is an annular member made of an elastic waterproof material and is located between the voice coil support 13 and the central post 15. The water-proofing unit 3 includes an inner ring section 31 for connecting to around the central post 15, an outer ring section 32 for circumferentially connecting to the voice coil support 13, and a connecting section 33 located between the inner ring section 31 and the outer ring section 32 to connect them to each other. The connecting section 33 has a cross-sectional shape that can be differently designed to be, for example, a downward curved shape, an upward curved shape, a corrugated shape or simply a flat shape. In the illustrated preferred embodiment, the connecting section 33 has a downward curved cross-sectional shape. The water-proofing unit 3 with the above structure does not cause any change of an original height of the speaker and a designed stroke of the voice coil 2. The water-proofing unit 3 not only provides the speaker with a waterproof effect, but also gives the voice coil 2 an increased stability.

With the above arrangements, the waterproof speaker of the present invention can be installed outdoors for use. For example, the waterproof speaker of the present invention can be mounted on a ship, a motorcycle, a beach buggy, or other outdoor positions. The diaphragm 11 and the waterproofing unit 3 together serve as a barrier to prevent external moisture from entering into the magnetic element 12 via the gap between the coaxial tweeter 16 and the voice coil support 13, so that the magnetic element 12, the suspension 14 and the voice coil 2 are simultaneously protected against moisture to prolong the service life of the speaker.

The waterproof speaker of the present invention effectively overcomes the shortage of the conventional coaxial speakers. More specifically, in the present invention, the diaphragm and the water-proofing unit cooperate with each other to prevent external moisture from reaching the magnetic element and form a protection means not only for the magnetic element, but also the suspension and the voice coil. It is also noted the water-proofing unit can be mounted in the speaker without changing the original height of the speaker and therefore, does not affect the stroke of the voice coil in operation. In addition to the waterproof effect, the water-proofing unit further enables increased stability of the voice coil and prolonged outdoor service life of the waterproof speaker.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A waterproof speaker, comprising:

a frame having a flared front opening, to which a diaphragm is mounted; a magnetic element being mounted to a rear end of the frame; a voice coil support being located in a central gap of the magnetic element and connected to the diaphragm; a suspension being located around an outer side of the voice coil support; a central post being located inside the voice coil support and associated with the magnetic element; and a coaxial tweeter being connected to the central post;

a voice coil being suspended in the central gap of the magnetic element and located around a lower part of the voice coil support below a middle point thereof; and a water-proofing unit being located between the voice coil support and the central post, wherein the water-proofing unit includes an inner ring section connected to around the central post, an outer ring section circumferentially connected to the voice coil support, and a connecting section located between the inner ring section and the outer ring section to connect the inner and the outer ring section to each other.

2. The waterproof speaker as claimed in claim 1, wherein the water-proofing unit is made of an elastic waterproof material.

3. The waterproof speaker as claimed in claim 1, wherein the connecting section of the water-proofing section has a downward curved cross-sectional shape.

4. The waterproof speaker as claimed in claim 1, wherein the connecting section of the water-proofing section has an upward curved cross-sectional shape.

5. The waterproof speaker as claimed in claim 1, wherein the connecting section of the water-proofing section has a corrugated cross-sectional shape.

6. The waterproof speaker as claimed in claim 1, wherein the connecting section of the water-proofing section has a flat cross-sectional shape.

* * * * *